United States Patent [19]

Yu

[11] Patent Number: 4,844,713

[45] Date of Patent: Jul. 4, 1989

[54] FRAGRANT LIQUEFIED PETROLEUM GAS COMPOSITION AND THE METHOD OF PREPARING THE SAME

[75] Inventor: Zhimiao Yu, Shanghai, China

[73] Assignee: Fragrant Liquefied Butane Gas Producing Company, Zhengzhou, China

[21] Appl. No.: 215,380

[22] Filed: Jul. 5, 1988

[30] Foreign Application Priority Data

Jul. 5, 1987 [CN] China ..... 87104659

[51] Int. Cl.[4] ..... C10L 1/10; C10L 3/00

[52] U.S. Cl. ..... 44/52; 48/195

[58] Field of Search ..... 44/52, 53; 48/195; 261/DIG. 17

[56] References Cited

U.S. PATENT DOCUMENTS 1,944,175 1/1934 Frey ..... 44/52
3,169,839 2/1965 Calva ..... 48/195
3,826,631 7/1974 Nevers ..... 44/52
4,025,315 5/1977 Mazelli ..... 44/52

*Primary Examiner*—Jacqueline V. Howard
*Attorney, Agent, or Firm*—Birch, Stewart, Kolasch & Birch

[57] ABSTRACT

A fragrant liquefied petroleum gas composition is disclosed which contains a uniform dispersion of an essence capable of producing fragrant odor. The composition of the invention is comprised essentially of butane with the weight ratio of essence to the liquefied petroleum gas in the range of 0.05–10:100. The fragrant liquefied petroleum gas composition is particularly useful as fuel for lighters. There is also disclosed a process for preparing the composition of the invention which comprises (a) admixing an essence in an acyclic monohydric alcohol to obtain a uniform solution; (b) introducing a liquefied petroluem gas by a high pressure inert gas into the essence/alcohol solution to obtain a homogeneous mixing and (c) removing the alcohol to obtain a liquefied petroleum gas composition containing the essence homogeneously dispersed therein.

18 Claims, No Drawings

FRAGRANT LIQUEFIED PETROLEUM GAS COMPOSITION AND THE METHOD OF PREPARING THE SAME

FIELD OF THE ART

The present invention relates to a fragrant liquefied petroleum gas composition which can be ignited by sparks and the method of preparing the same. More particularly, the present invention pertains to a fragrant liquefied petroleum gas composition comprised essentially of butane useful as fuel for lighters and the method of preparing the same.

BACKGROUND OF THE INVENTION

Liquefied petroleum gas presently used as fuel for lighters usually has an irritating smell owing to the presence of sulfur compounds such as hydrogen sulfide and/or mercaptan, etc. Although it is possible to subject the liquefied petroleum gas to one or more steps of desulfurization treatment prior to its use as fuel for lighters, the liquefied petroleum gas still has an intrinsic smell of the mixed hydrocarbon gases. Attempts have been made to add a certain essence to the liquefied petroleum gas to improve its smell,, but, up to now, no practical method for mixing essence homogeneously therewith to prepare a fragrant composition gas has been found. This is owing to the fact that the liquefied petroleum gas and the main components in essence such as citral, linalool and geranene have their own structural characteristics and that the specific gravity of the two are quite different,which will cause the formation of two distinct layers upon mixing, resulting in incompatible mixing of the essence in the liquefied petroleum gas.

SUMMARY OF THE INVENTION

The present invention provides a liquefied petroleum gas composition comprised essentially of butane useful as fuel for lighters, which is characterized by containing an amount of essence uniformly dispersed therein capable of producing fragant odor.

The present invention also provides a process for preparing the fragrant liquefied petroleum gas composition of the invention by which the intended essence can be homogeneously added thereto.

According to one embodiment of the present invention, a fragrant liquefied petroleum gas composition useful as fuel for lighters is provided by employing the commercially available liquefied gas fuel for lighters which usually contains more than 60% by weight, preferably more than 90% by weight of butane as the starting material, and subjecting the starting material to the essence-adding procedure of the invention.

According to another embodiment of the present invention, a fragrant liquefied petroleum gas composition is provided by treating a feedstock containing a substantial amount of propane in addition to butane by the procedures of propane-separation and then essence-adding.

According to still another embodiment of the present invention, a fragrant liquefied petroleum gas composition is provided by treating a feedstock containing sulfur compounds by the procedures of a two step desulfurization and essence-adding.

According to still another embodiment of the present invention, a process of cooling/propane-separation/-two-step-desulfurization/essence-adding is provided to obtain a fragrant liquefied petroleum gas composition.

The word "essence" referred to throughout the specification includes natural and synthetic perfumes or essences as well as the formulations of natural perfumes and/or synthetic perfumes.

The phrase "liquefied petroleum gas composition useful as fuel for lighters" referred to throughout the specification means the liquefied petroleum gas consisting essentially of butane in an amount not less than 60% in which a minor amount of propane and/or pentane may be present.

DETAILED DESCRIPTION OF THE INVENTION

The common fuel for use in lighters is what is called "liquefied butane gas" which contains essentially butane usually in an amount more than 60 wt. % and preferably more than 90 wt. %. The liquefied petroleum gas composition of this invention has no substantial difference with the conventional butane gas for use in lighters in its composition of combustible gases, but is characterized in that it contains a certain amount of essence which produces fragrant odor. The essence is homogeneously dispersed in the liquefied petroleun gas, thus not only eliminating the bad smell of the gas but also giving fragrant scent of fruits or flowers.

The weight ratio of the essence added to the liquefied petroleum gas according to the invention is in the range of 0.05–10:100, preferably in the range of 0.1–1:100.

The process of adding essence to the liquefied petroleum gas provided by the present invention comprises:

(a) admixing the intended essence in an acyclic monohydric alcohol to make a uniform predetermined solution under normal temperature and pressure;

(b) introducing the liquefied petroleum gas by high pressure inert gas into the alcohol solution to obtain a homogeneous mixing;

(c) removing the acyclic monohydric alcohol to obtain a liquefied petroleum gas composition containing the essence.

The essence intended to be added into the liquefied petroleum gas is first dissolved in acyclic mydric alcohol, preferably ethanol, to form a solution. The concentration of the essence in said solution can be selected within a wide range without adversely affecting the effect according to the invention. Generally, the essence is dissolved in ethanol in a concentration of 5–90% by weight, preferably 5–40% by weight. No specific conditions are required when dissolving the essence in the alcohol.

A liquefied petroleum gas, preferably comprised essentially of butane, is pressurized with high pressure inert gas, preferably $N_2$, to 2–8 kg/cm$^2$, and introduced into the vessel containing said essence/alcohol solution under the same pressure to make an intimate mixing thereof.

After a given amount of liquefied petroleum gas has been pressurized into the vessel containing the essence/alcohol solution, alcohol can be withdrawn from the bottom of the vessel while the introduction of the liquefied petroleum gas is stopped.

In the above described method of the invention, the liquefied petroleum gas to which an essence is added should preferably be comprised of butane in an amount not less than 60% by weight, and most preferably 90% by weight, for the purpose that the fragrant liquefied petroleum gas to be prepared is for use as fuel in lighters. It is apparent that if the final product is intended for other purposes, compositions of the liquefied petroleum gas should be determined accordingly and the essence-adding procedure according to the invention is also applicable.

In the case that the liquefied petroleum gas contains a substantial amount of propane, it is necessary to separate it therefrom prior to the essence-adding procedure of the invention to increase the butane concentration and therefore high quality fuel for lighters can be obtained. In the process of the invention, propane is separated by first cooling the liquefied petroleum gas to −40°–10° C. and then volatilizing propane by releasing it to normal pressure. Time required for volatilizing varies depending on the amount of propane present therein, and the separated propane can be used for other purposes.

The liquefied petroleum gas from which propane has been separated and which is comprised essentially of butane can be used directly in the essence-adding procedure of the invention, to which an essence is added. However, in the case where the liquefied petroleum gas contains sulfur compounds such as $H_2S$ and mercaptan, etc., desulfurization treatment is required. In such a case, the present invention employs a two-step desulfurization, i.e, removing $H_2S$ through an aqueous solution of NaOH (10–45%) and removing mercaptan through activated carbon or molecular sieve.

In the procedure of the two-step desulfurization,the liquefied petroleum gas is transmitted with a high pressure inert gas, preferably $N_2$, of 2–8 kg/cm$^2$ and introduced through the desulfurizer containing aqueous solution of NaOH and the desulfurizer containing activated carbon or molecular sieve.

Thus, a process of cooling/propane-separation/two-step desulfurization/essence-adding is provided by the present invention for treatment of liquefied petroleum gas to obtain the further increased quality product of the invention. According to different starting materials and the desired final product, all the steps are not always required in the above given order. However, when liquefied petroleum gas or refinery liquefied butane gas is used to prepare a fragrant gas fuel (liquefied) for lighters, it is preferred to carry out the process with all the procedures so as to reduce the content of undesirable light components and impurities to increase product quality.

It should be noted that the present invention has no specific restriction to the starting materials employed since fluctuations of the components in the liquefied petroleum gas has no adverse effect on the essence adding process, which is a distinct feature of the invention, while in the preparation of the fragrant liquefied fuel composition for use in lighters, conventional treatments can always be used for purifying the starting material prior to the procedure of essence-adding. Also, liquefied petroleum gas with fragrancy for other purposes can be prepared according to the present invention. The invention will be described in detail by the following nonlimitative examples.

EXAMPLE 1

90 grams of bayberry essence was dissolved in 70% industrial ethanol to obtain a homogeneous solution under normal temperature and pressure. The amount of ethanol used was such that the resulting solution contained about 20% by weight of the essence. The solution of the essence/ethanol was charged to the essence-adding tank.

15 kilograms of butane gas ($C_4H_{10}$: about 90 wt. %, $C_3H_8$: about 10 wt. %, with substantially no sulfur compounds) in a pressure vessel (volume: 35 liters) was pressurized with $N_2$ to a pressure of 6–8 kg/cm$^2$ and was introduced into the essence-adding tank containing the solution of essence/ethanol under such pressure. The introduced liquefied butane gas was intimately mixed with the essence/ethanol solution and stood for 5 to 10 minutes. Then ethanol was discharged through the valve at the bottom of the essence-adding tank to obtain a fragrant liquified butane gas having a bayberry scent (essence concentration: 3°/00–6°/00).

EXAMPLE 2

15 kilograms of butane gas (containing $C_4H_{10}$: about 90 wt. %, $C_3H_8$: about 10 wt. %, sulfur compounds) was pressurized with high pressure $N_2$ to 8 kg/cm$^2$ and was transferred through a pipe into a stainless steel desulfurizer (filled with porcelain rings of 50% vessel volume and 12 to 15 kilograms of 20% aqueous NaOH solution) in a flow rate of 30 l/hour to remove $H_2S$ present in the gas, and then the liquefied butane gas was further transferred with the pressurized $N_2$ into a stainless desulfurizer containing decolorizing and deodorizing activated carbon to remove the organic sulfur compounds.

The essence/ethanol solution was prepared as in Example 1 except that 90 grams of rose essence was used in this example and the essence concentration of the solution was 25%.

The desulfurized liquefied butane gas was introduced under $N_2$ pressure of 6–8 kg/cm$^2$ into the essence-adding tank with the following procedure being the same as that of Example 1 to obtain a fragrant liquefied butane gas with rose scent (essence concentration 3°/00–6°/00).

EXAMPLE 3

15 kilograms of liquefied petroleum gas comprised of butane and propane ($C_4H_{10}$: about 40 wt. %, $C_3H_8$: 50 wt. % and possibly small amounts of pentane, sulfur compounds) in a pressure vessel was cooled to −2°C. to volatilize propane for a period of 1 hour. Then the liquefied petroleum gas comprised essentially of butane (more than 70 wt. %) was pressurized with $N_2$ to 5 kg/cm$^2$ and was subjected to the two-step desulfurization as in Example 2.

The essence/ethanol solution was prepared as in Example 1 except that 60 g lemon essence was used in this example and the concentration of the essence in ethanol was 30%.

The desulfurized liquefied butane gas was introduced into the solution of essence/ethanol to be treated as in Example 1 to obtain a fragrant liquefied butane gas with lemon scent, having a concentration of the essence of 3°–6°/00.

The fragrant liquefied petroleum gas product according to the present invention is transparent and has no precipitates, and the added essence is homogeneously dispersed in the liquefied petroleum gas. Said product is suitable for use in electronic and flint lighters.

What I claim is:

1. A liquefied petroleum gas composition useful as fuel for lighters, characterized by containing a uniform dispersion of an essence capable of producing fragrant odor.

2. A liquefied petroleum gas composition in accordance with claim 1, wherein said essence is selected from natural perfumes, synthetic essences and formulations of natural essences and/or synthetic essences.

3. A liquefied petroleum gas composition in accordance with claim 1, wherein the weight ratio of said essence to the liquefied petroleum gas is in the range of 0.05–10:100.

4. A liquefied petroleum gas composition in accordance with claim 1, wherein the weight ratio of said essence to the liquefied petroleum gas is in the range of 0.1–1:100.

5. A liquefied petroleum gas composition in accordance with claim 1, wherein said composition is essentially comprised of butane with an essence dispersed therein.

6. A liquefied petroleum gas composition in accordance with claim 5, wherein said composition is essentially comprised of butane and propane with an essence dispersed therein.

7. A process for preparing the liquefied petroleum gas composition as set forth in claim 1 comprising:

(a) admixing an intended essence in an acyclic monohydric alcohol to obtain a uniform solution under normal temperature and pressure;

(b) introducing a liquefied petroleum gas by a high pressure inert gas into the essence/alcohol solution to obtain a homogeneous mixing;

(c) removing the acyclic monohydric alcohol to obtain a liquefied petroleum gas composition with the essence homogeneously dispersed in it.

8. A process in accordance with claim 7, wherein said acyclic monohydric alcohol is ethanol.

9. A process in accordance with claim 7, wherein the essence is admixed with the acyclic monohydric alcohol in a concentration in the range of 5–90% by weight, preferable in the range of 5–40% by weight.

10. A process in accordance with claim 7, wherein said inert gas is $N_2$.

11. A process in accordance with claim 7, wherein the pressure of said inert gas is in the range of 2 to 8 kg/cm$^2$.

12. A process in accordance with claim 7, further comprising a procedure of separating propane from the liquefied petroleum gas by first cooling it to −40°–10° C. and then volatilizing propane prior to said (a), (b) and (c).

13. A process in accordance with claim 7, further comprising a two-step desulfurization prior to said (a), (b) and (c), said two-step desulfurization comprises:

removing $H_2S$ present in the liquefied petroleum gas with an aqueous solution of NaOH having a concentration of 10–45%;

removing organic sulfur compounds present in the liquefied petroleum gas with activated carbon or molecular sieve.

14. A process in accordance with claim 13, wherein the liquefied petroleum gas is introduced through the desulfurizer by high pressure inert gas with a pressure ranging from 2 to 8 kg/cm$^2$.

15. A process for preparing the liquefied petroleum gas composition as set forth in claim 1, which comprises:

(l) using a liquefied petroleum gas mainly comprised of butane and propane or refinery butane gas as the starting material;

(2) cooling the starting material to −40°–10° C.;

(3) volatilizing propane from the starting material;

(4) subjecting the starting material further to a two-step desulfurization in which the feedstock is first carried to the desulfurizer containing an aqueous solution of NaOH having a concentration of 10–45% to remove $H_2S$, and then to a desulfurizer containing activated carbon or molecular sieve to remove organic sulfur compounds by a high pressure inert gas having a pressure of 2–8 kg/cm$^2$;

(5) introducing the desulfurized feedstock into an essence/alcohol solution by a high pressure inert gas to obtain a homogeneous mixing, wherein said essence/alcohol solution is prepared beforehand by admixing the intended essence in a noncyclic monohydric alcohol in an amount such that the obtained admixture has an essence concentration of 0.5–90% by weight and the weight ratio of the essence to the desulfurized feedstock is in the range of 0.5°–10°/00 by weight, and removing the acyclic monohydric alcohol to obtain a liquefied petroleum gas composition with an essence homogeneously dispersed.

16. A process in accordance with claim 15 wherein said inert gas is $N_2$.

17. A process in accordance with claim 15, wherein said acyclic monohydric alcohol is ethanol.

18. A process in accordance with claim 15, wherein the concentration of the essence in the essence/alcohol solution is in the range of 0.5–40% by weight.

* * * * *